US011014718B2

(12) United States Patent
Ludwig

(10) Patent No.: US 11,014,718 B2
(45) Date of Patent: May 25, 2021

(54) FLEXIBLE BALL VALVE FOR LIQUID METERING AND DISPENSING

(71) Applicant: ILLINOIS TOOL WORKS INC., Glenview, IL (US)

(72) Inventor: Christopher Ludwig, Buffalo Grove, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 16/607,243

(22) PCT Filed: Apr. 27, 2018

(86) PCT No.: PCT/US2018/029741
§ 371 (c)(1),
(2) Date: Oct. 22, 2019

(87) PCT Pub. No.: WO2018/200926
PCT Pub. Date: Nov. 1, 2018

(65) Prior Publication Data

US 2020/0377270 A1 Dec. 3, 2020

Related U.S. Application Data

(60) Provisional application No. 62/490,754, filed on Apr. 27, 2017, provisional application No. 62/545,229, filed on Aug. 14, 2017.

(51) Int. Cl.
*B65D 47/20* (2006.01)
*B65D 75/58* (2006.01)
*B65D 83/00* (2006.01)

(52) U.S. Cl.
CPC ..... *B65D 47/2018* (2013.01); *B65D 75/5883* (2013.01); *B65D 83/0055* (2013.01); *B65D 2575/58* (2013.01)

(58) Field of Classification Search
CPC ..... B65D 47/2018; B65D 47/2025; B65D 47/2031; B65D 75/5883; B65D 75/58;
(Continued)

(56) References Cited

U.S. PATENT DOCUMENTS 1,869,808 A * 8/1932 Hancock ..... B65D 47/2075 222/496
2,692,751 A * 10/1954 Felver ..... F16K 1/14 251/342

(Continued)

FOREIGN PATENT DOCUMENTS

FR 2938057 5/2010
WO 2018/200926 11/2018

OTHER PUBLICATIONS

International Search report issued in PCT/US/2018/028327 dated Aug. 27, 2018.

*Primary Examiner* — Paul R Durand
*Assistant Examiner* — Andrew P Bainbridge
(74) *Attorney, Agent, or Firm* — McCarter & English, LLP

(57) ABSTRACT

The present disclosure relates to a plastic valve and method for forming a plastic valve comprising an exterior base layer, an interior bubble layer and an exterior channel layer, wherein a flow channel is formed between the bubble layer and the channel layer. In a first aspect of the disclosure, a rigid or semi-rigid spherical ball travels between first and second ends of a channel molded into the bubble layer, thereby moving between a closed configuration and an open configuration. In a second aspect of the disclosure, a bubble is formed between the bubble layer and the base layer of plastic film, and includes a static planar footprint and a pre-tension height. The channel layer is applied to the bubble layer under tension to form a channel. Applying the channel layer decreases a height of the bubble from the (Continued)

pre-tension height to a post-tension height and increases an internal pressure of the bubble.

26 Claims, 3 Drawing Sheets

(58) Field of Classification Search
CPC ..... B65D 83/0055; B65D 2575/58; B65D 2575/583; B65D 2575/586; B65D 47/2037; B65D 47/2043; B65D 47/205; B65D 83/0077; B65D 83/0094; F16K 7/00; F16K 7/04; F16K 31/465; F16K 41/12
USPC ..... 222/206–207, 209, 212–213, 215, 147, 222/494–498; 251/294, 335.1, 341, 342
See application file for complete search history.

(56) References Cited

U.S. PATENT DOCUMENTS 2,964,292 A * 12/1960 Rene Noir ..... F16K 27/0245 251/342
3,567,079 A * 3/1971 Weigand ..... B65D 35/40 222/213
3,635,376 A * 1/1972 Hellstrom ..... B65D 75/30 222/107
3,819,151 A * 6/1974 Kish ..... F16K 31/44 251/342
4,286,664 A * 9/1981 Bolding, Jr. ..... E21B 21/10 137/537
4,601,413 A * 7/1986 Krawagna ..... B65D 47/26 222/498
5,022,422 A * 6/1991 di Palma ..... A61M 39/22 137/15.18
5,265,847 A * 11/1993 Vorhis ..... F16K 7/02 222/513
5,573,033 A * 11/1996 Litzel ..... F16K 23/00 137/512.3
6,286,725 B1 * 9/2001 Gerber ..... B65D 47/2075 222/207
7,207,717 B2 * 4/2007 Steele ..... B65D 33/01 383/10
7,883,268 B2 2/2011 Steele
8,042,714 B2 * 10/2011 Miyazaki ..... B65D 51/20 222/494
8,613,547 B2 12/2013 Steele
8,844,743 B2 * 9/2014 Costa ..... B65D 1/0292 220/253
9,334,969 B2 * 5/2016 Berwanger ..... F16K 7/04
9,352,897 B2 * 5/2016 Hoshino ..... B65D 83/48
9,963,284 B2 5/2018 Steele
10,155,354 B2 12/2018 Steele
2002/0169424 A1 * 11/2002 Miles ..... A61M 5/142 604/256
2011/0042407 A1 2/2011 Steele
2013/0214184 A1 * 8/2013 Miyazaki ..... A61M 5/14232 251/4
2014/0155240 A1 6/2014 Steele
2016/0297571 A1 * 10/2016 Steele ..... B65D 75/008
2020/0130899 A1 * 4/2020 Ludwig ..... B65D 33/2508
2020/0189810 A1 * 6/2020 Ludwig ..... B65D 47/2018

* cited by examiner

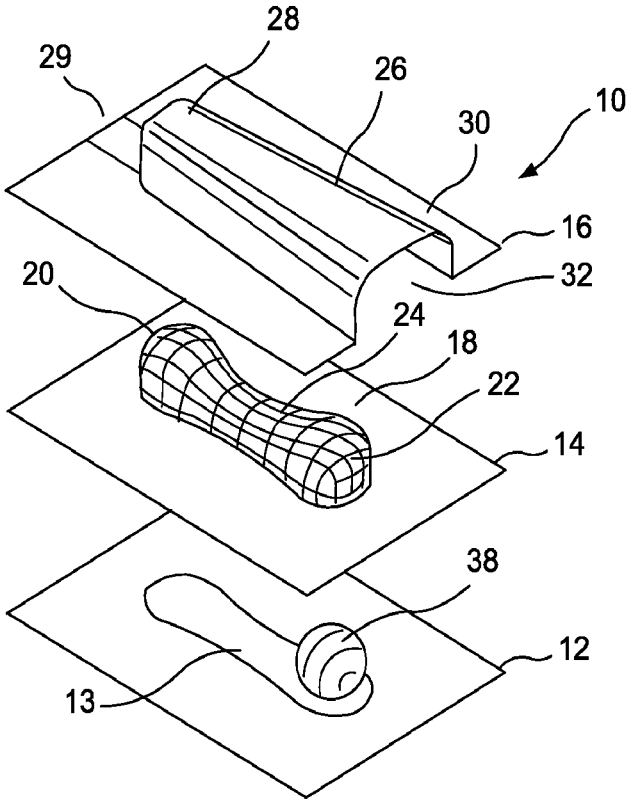
F I G. 1
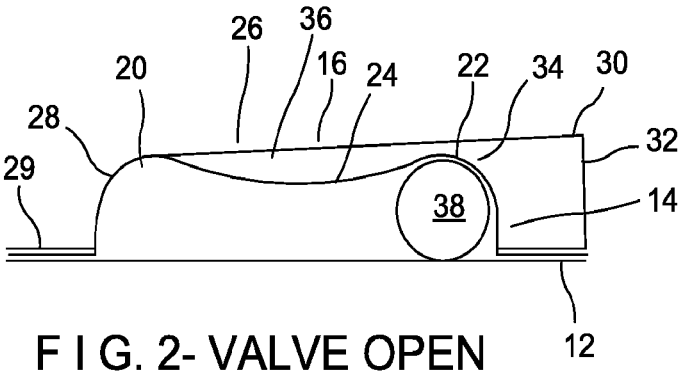
F I G. 2- VALVE OPEN
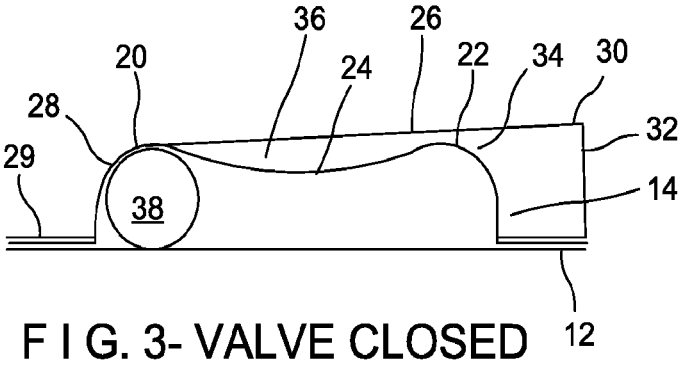
F I G. 3- VALVE CLOSED

FLEXIBLE BALL VALVE FOR LIQUID METERING AND DISPENSING

This application is a National Phase Application of PCT/US2018/029741, filed Apr. 27, 2018 which claims priority of U.S. Provisional Application Ser. No. 62/490,754, filed on Apr. 27, 2017 and U.S. Provisional Application Ser. No. 62/545,229, filed on Aug. 14, 2017, the contents of the disclosure of both of which are incorporated by reference herein for all purposes.

BACKGROUND OF THE DISCLOSURE

Field of the Disclosure

The present disclosure relates to a bubble valve, typically made of plastic or polymeric material, including a flexible ball valve, for flexible containers containing liquid, and a method for forming the bubble valve. A bubble is formed between a bubble layer and a base layer of plastic film, and a ball travels between two positions within the bubble. A channel layer (typically an exterior layer) is applied to the bubble layer (typically an interior layer) to form a channel between the channel layer and the bubble layer.

Description of the Prior Art

Prior art packaging in the food/beverage, personal care and household care industries is primarily a combination of a rigid bottle or semi-flexible tube with a rigid fitment or cap of varying dispense types. Transition to flexible pouches for the main body of the container has continued to utilize similar, still rigid, fitments. There exists a need within these industries to complete the transition in order to create a fully flexible solution. Such a solution would improve functionality by representing both a flow control mechanism and a re-close feature, enhance, the overall sustainability profile and cost reduction of the packaging through material reduction and operational efficiency gains, and improved performance expectations.

Prior art iterations of a plastic valve for flexible pouches required many manufacturing steps, material, and time. First, a rectangular pocket of ambient air is trapped between two sheets of plastic film. Then the pocket is repeatedly condensed in footprint by the use of successive heat seals on pouch making equipment. Reduction of the area gradually increases the amount of internal pressure within the formed bubble. There exists a need for a method of manufacturing a bubble in flexible packaging using less manufacturing steps, material, and time.

The prior art includes U.S. Pat. No. 8,613,547 entitled "Packages Having Bubble-Shaped Closures"; U.S. Pat. No. 7,883,268 entitled "Package Having a Fluid Activated Closure"; U.S. Pat. No. 7,207,717 entitled "Package Having a Fluid Activated Closure"; U.S. Published Application 2014/0155240 entitled "Stationary Closure Device and Package"; and U.S. Published Application 2016/0297571 "Package Valve Closure System and Method."

OBJECTS AND SUMMARY OF THE DISCLOSURE

It is therefore an object of the present disclosure to provide improved dispensing valves for flexible packages, particularly fluid-activating closures or dispensing valves.

In a first aspect of the disclosure, this and other objects are attained by providing a closure which uses a small pellet which is entrapped within a fixed path formed by sealing a pattern into two sheets of flexible plastic film.

In a second aspect of the disclosure, this and other objects are attained by providing a valve made of a channel and an encapsulated air bubble that can be attached to a flexible package to enable the controlled release of liquid products by means of applying pressure.

In the manufacturing of this second aspect of the disclosure, a bubble layer of plastic film is applied to a base layer of plastic film and a bubble is formed between the bubble layer and the base layer. The bubble has a static planar footprint and a pre-tension height. A channel layer of plastic film is applied to the bubble layer of plastic film under tension to form a channel between the channel layer and the bubble layer. Applying the channel layer decreases a height of the bubble from the pre-tension height to a post-tension height and increases an internal pressure of the bubble.

In this second aspect of the disclosure, the valve is made of three layers of plastic film—a base layer, a bubble layer, and a channel layer. The base layer is sealed to the base layer and the channel layer is sealed to at least one of the base layer and the bubble layer. A bubble is formed between the bubble layer and the base layer, and the bubble includes a static planar footprint and a post-tension height. A channel is formed between the channel layer and the bubble layer, and the channel is operable to dispense liquid products from a container when a user applies a sufficient pressure on the container.

BRIEF DESCRIPTION OF THE DRAWINGS

Further objects and advantages of the disclosure will become apparent from the following description and from the accompanying drawings, wherein:

FIG. 1 is an exploded perspective view of an embodiment of the first aspect of the disclosure.

FIG. 2 is a cross-sectional view along an open configuration of the valve of FIG. 1.

FIG. 3 is a cross-sectional view along a closed configuration of the valve of FIG. 1.

DETAILED DESCRIPTION OF THE PREFERRED EMBODIMENTS

Figure 4B:
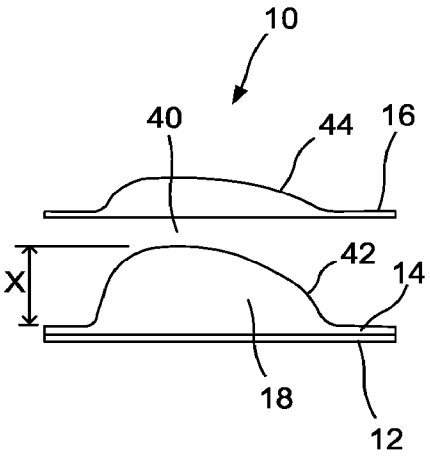
FIG. 4B is a side view illustrating assembly of the plastic valve in the embodiment of the second aspect of the present disclosure.

Referring now to the drawings in detail, wherein like numerals indicate like elements throughout the several views, one sees that FIGS. 1-3 illustrate a first aspect of the present disclosure. A valve 10 is formed from a base layer 12, a bubble layer 14 and a channel layer 16, positioned sequentially. These layers 12, 14, 16 are semi-rigid, and are typically thermoformed. However, other methods may be available to provide these layers. A base layer 12 is provided which is essentially planar, but may optionally include a barbell-shaped indentation 13 to complement the barbell-shaped path 18 of bubble layer 14. A bubble layer 14 is provided over the base layer 12. The bubble layer 14 includes a protruded barbell-shaped path 18, enclosed from the bottom by base layer 12, with first and second enlarged ends 20, 22 connected by a relatively narrow central passage 24.

The channel layer 16 includes an enlarged hood 26 with a first end 28 of somewhat reduced diameter and a second end 30 of somewhat increased diameter with respect to the first end 28. A fluid inlet channel 29 is formed on channel layer 16, leading to first end 28 of enlarged hood 26. The second end 30 of enlarged hood 26 includes an exit opening 32 so as to provide a flow exit for the valve 10. The barbell-shaped path 18 of bubble layer 14 extends into enlarged hood 26. The upper surface of enlarged hood 26 is somewhat inclined so that first end 28 of enlarged hood 26 conforms tightly against first enlarged end 20 of bubble layer 14 while second end 30 of enlarged hood 26 (and areas inwardly adjacent thereof) forms a gap 34 with respect to second enlarged end 22 of barbell-shaped path 18. This gap 34 provides a fluid flow path leading from the space 36 between the exterior of relatively narrow central passage 24 and the interior of enlarged hood 26 to the exit opening 32 of the enlarged hood 26.

A semi-rigid or rigid pellet 38, typically spherical or substantially spherical and the size of a pea, is captured or entrapped and travels, in response to manual activation by the user, within the barbell-shaped path 18 between stable or seated configurations in first enlarged end 20 (FIG. 3, valve closed) and second enlarged end 22 (FIG. 2, valve open). In FIG. 2, pellet 38 is in the second enlarged end 22 of barbell-shaped path 18 so that the first enlarged end 20 of barbell-shaped path 18 is free of the pellet 38. In this configuration, fluid flow can be effectuated from fluid inlet channel 29 between the bubble layer 14 and the channel layer 16, through space 36 (between the exterior of central passageway 24 and the interior of enlarged hood 26), through gap 34 and out exit opening 32. This flow from fluid inlet channel 29 to exit opening 32 results in an open configuration of the valve 10.

However, in FIG. 3, pellet 38 is in the first enlarged end 20 of barbell-shaped path 18. This configuration forms a liquid-tight relationship between the first enlarged end 20 of the barbell-shaped path 18 of bubble layer 14 and the first end 28 of enlarged hood 26 of channel layer 16 thereby blocking flow from the fluid inlet channel 29. This results in a closed configuration of valve 10.

Figure 4A:
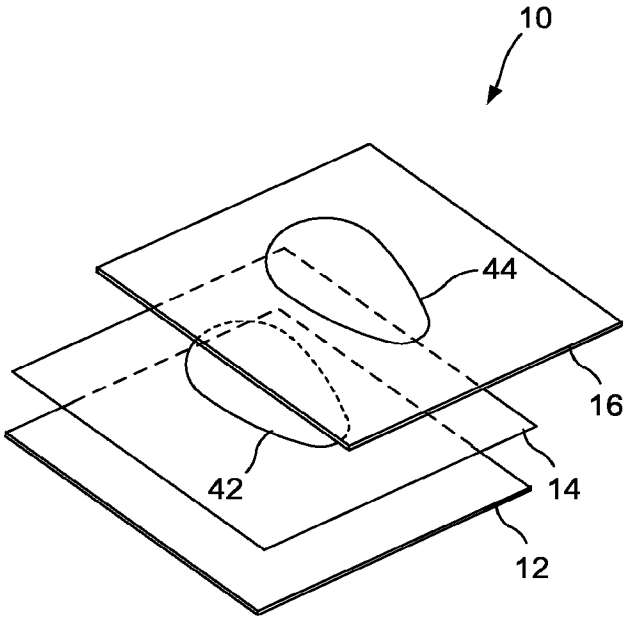
FIG. 4A is a perspective view illustrating layers of a plastic valve in an embodiment of the second aspect of the present disclosure.

In FIGS. 4A and 4B, one sees the disclosed embodiment of the second aspect of the present disclosure of a plastic or polymeric valve 10, comprising of a bubble 18 and a channel 40, utilizing air, gas or other fluid that is trapped between two layers of film—a base layer 12 and a bubble layer 14—to create the bubble 18 of a desired shape and size to act as a flow regulator. The shaping and dimensions of this bubble 18, along with the film types can be customized to the specific needs of the product (including liquid viscosity) and/or user requirements. A liquid channel 40 is formed around the bubble by two layers—the bubble layer 14 and a channel layer 16—sealed together through which liquid can flow from the package.

The plastic valve 10 includes a base layer 12 (i.e., first layer) of plastic film, a bubble layer 14 (i.e., second layer) of plastic film, and a channel layer 16 (i.e., third layer) of plastic film. The plastic (or polymeric) film is some variant of a flexible plastic or polymeric film. If the plastic valve 10 is used in a food setting, the plastic film should be compliant with food safety and chemical regulations. In some embodiments, each layer 12, 14, 16 of plastic film is a multi-layer laminate film. A multi-laminate film may provide, among other things, sealant capabilities desired by a manufacture or user. The plastic film is made of, for example, but not limited to, polyethylene and/or polypropylene or a combination thereof. In one embodiment, the base layer 12 is made of a first plastic film and the bubble layer 14 and channel layer 16 are made of a second plastic film differing from the first plastic film.

A static planar footprint 42 is embossed or formed on the bubble layer 14 of plastic film thereby forming the shape of bubble 18, and may include semi-rigid or rigid spherical pellet. The static planar footprint 42 is formed using a at least one of vacuum forming and thermoforming processes. The bubble layer 14 with embossed static planar footprint 42 (thereby forming bubble 18) is applied to the base layer 12 of plastic film. Thus, bubble 18 forms from ambient air (or other gas or fluid) captured between the bubble layer 14 and the base layer 12 with the static footprint 42 and a pre-tension height ("X"). FIG. 4B illustrates the assembly of valve 10 after the application of the bubble layer 14 to the base layer 12. The step of applying plastic film layers—base layer 12, bubble layer 14—to each other is accomplished by, for example, but not limited to, sealing the two layers of plastic film together using heat or ultrasonics. In some embodiments, two or three of the plastic film layers—base layer 12, bubble layer 14, channel layer 16—are made of a single plastic film that has been folded.

Next, the channel layer 16 of plastic film is applied to the bubble layer 14 of plastic film. In the embodiment illustrated in FIGS. 4A and 4B, the channel layer 16 is embossed or formed. The channel layer 16 is embossed with a channel footprint 44 that is larger than the static planar footprint 42 of the bubble layer 14. Larger, as in, for example, but not limited to, a wide planar footprint or a loose/more material in the emboss/form. The channel footprint 44 is formed using at least one of vacuum forming and thermoforming processes. In one embodiment, the channel footprint 44 of the embossed channel layer 16 is formed using both vacuum forming and thermoforming processes.

The channel layer 16 is sealed to at lest one of the base layer 12 and the bubble layer 14 using heat or ultrasonics. A channel 40 forms between the channel layer 16 and the bubble layer 14. The channel 40 allows and controls dispensing of liquid products from a container when a user applies pressure by squeezing the container. When the applied pressure is greater than the pressure between the bubble layer 18 and the channel layer 16, the channel 40 opens and the liquid product flows past the plastic valve 10 (i.e., formed from layers 12, 14, 16). When the applied pressure is less than the pressure between the bubble 18 and the channel layer 16, the channel 40 closes and the liquid product stops flowing past the plastic valve 10.

Figure 5:
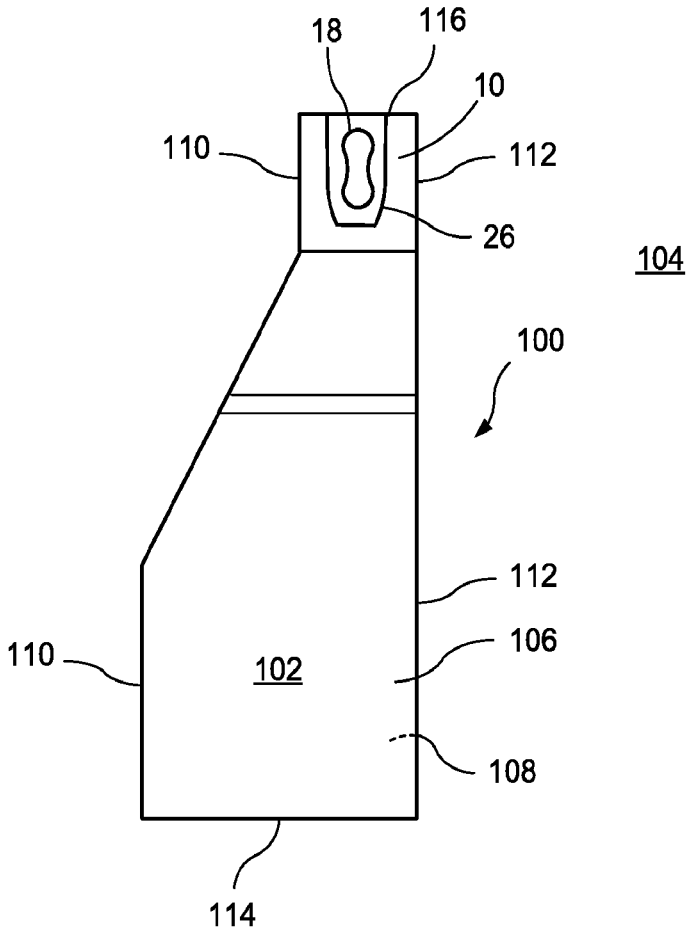
FIG. 5 is a plan view of a pouch or package including a valve of the first aspect of the disclosure.

FIG. 5 illustrates an embodiment of a package or pouch 100 utilizing the valve of the present disclosure. The illustrated pouch 100 includes a lower enlarged storage volume 102 and an upper neck (or storage access opening) 104, typically formed from first and second co-extensive sheets of polymeric material 106, 108 forming first and second panel portions. The interior of upper neck 104 houses the valve 10 and further provides a pathway from the storage volume 102 (typically containing consumer product) to the exterior of the package 100.

Thus, the several aforementioned objects and advantages are most effectively attained. Although preferred embodiments of the invention have been disclosed and described in detail herein, it should be understood that this invention is in no sense limited thereby.

What is claimed is:

1. A valve comprising:

a channel layer including an inlet and an outlet with a fluid communication channel between the inlet and the outlet;

a bubble layer including a protruded path extending into a side of the fluid communication channel, the protruded path including a first enlarged end and a second enlarged end, the first enlarged end of the protruded path at least partially blocking the fluid communication channel, and the second enlarged end of the protruded path being separated from the channel layer thereby forming a gap, the gap being a part of the fluid communication channel; and a ball-like element captured within said protruded path, the ball-like element travelling between a first configuration and a second configuration wherein, in the first configuration, the ball-like element is seated in the first enlarged end of the protruded path thereby positioning the bubble layer to block the fluid communication channel and, wherein, in the second configuration, the ball-like element is in the second enlarged end of the protruded path thereby allowing flow through the fluid communication channel.

2. The valve of claim 1 wherein the channel layer is a first thermoformed sheet and the fluid communication channel is a hood formed in the sheet.

3. The valve of claim 2 wherein the hood impinges against the first enlarged end of the protruded path and is separated from the second enlarged end by the gap.

4. The valve of claim 3 wherein the hood is inclined with respect to the protruded path.

5. The valve of claim 4 wherein the inlet is positioned on the channel layer proximate to the first enlarged end of the protruded path of the bubble layer and the outlet is positioned on the channel layer proximate to the second enlarged end of the protruded path.

6. The valve of claim 5 wherein the bubble layer is a second thermoformed sheet.

7. The valve of claim 6 wherein the protruded path is thermoformed into the second thermoformed sheet.

8. The valve of claim 7 further including a third thermoformed sheet enclosing the protruded path.

9. The valve of claim 8 wherein the second thermoformed sheet is positioned between the first thermoformed sheet and the third thermoformed sheet.

10. A valve comprising:

a first polymeric layer including an enlarged hood, the hood including an inlet and an outlet with a fluid communication channel between the inlet and the outlet;

a second polymeric layer including a protruded path extending into the fluid communication channel of the hood, the protruded path including a first enlarged end and a second enlarged end, the first enlarged end of the protruded path at least partially blocking the fluid communication channel, and the second enlarged end of the protruded path being separated from the first polymeric layer thereby forming a gap, the gap being a part of the fluid communication channel; and a substantially spherical element captured within said protruded path, the spherical element travelling between a first configuration and a second configuration wherein, in the first configuration, the spherical element is seated in the first enlarged end of the protruded path thereby positioning the second polymeric layer to block the fluid communication channel and, wherein, in the second configuration, the spherical element is seated in the second enlarged end of the protruded path thereby allowing flow through the fluid communication channel.

11. The valve of claim 10 wherein the hood impinges against the first enlarged end of the protruded path and is separated from the second enlarged end by the gap.

12. The valve of claim 11 wherein the hood is inclined with respect to the protruded path.

13. The valve of claim 12 wherein the inlet is positioned on the first polymeric layer proximate to the first enlarged end of the protruded path of the second polymeric layer and the outlet is positioned on the first polymeric layer proximate to the second enlarged end of the protruded path.

14. The valve of claim 13 wherein the first polymeric layer is a first thermoformed sheet and the second polymeric layer is a second thermoformed sheet.

15. The valve of claim 14 wherein the protruded path is thermoformed into the second thermoformed sheet.

16. The valve of claim 15 further including a third thermoformed sheet enclosing the protruded path.

17. The valve of claim 16 wherein the second thermoformed sheet is positioned between the first thermoformed sheet and the third thermoformed sheet.

18. A package for holding material, comprising:

a first panel portion and a second panel portion;

the first panel portion and the second panel portion connected together to define a storage volume, the storage volume being accessible through an access opening;

the access opening including a valve, the valve including:

a first polymeric layer including an enlarged hood, the hood including an inlet and an outlet with a fluid communication channel between the inlet and the outlet;

a second polymeric layer including a protruded path extending into the fluid communication channel of the hood, the protruded path including a first enlarged end and a second enlarged end, the first enlarged end of the protruded path at least partially blocking the fluid communication channel, and the second enlarged end of the protruded path being separated from the first polymeric layer thereby forming a gap, the gap being a part of the fluid communication channel; and a substantially spherical element captured within said protruded path, the spherical element travelling between a first configuration and a second configuration wherein, in the first configuration, the spherical element is seated in the first enlarged end of the protruded path thereby positioning the second polymeric layer to block the fluid communication channel and, wherein, in the second configuration, the spherical element is seated in the second enlarged end of the protruded path thereby allowing flow through the fluid communication channel.

19. The package of claim 18 wherein the hood impinges against the first enlarged end of the protruded path and is separated from the second enlarged end by the gap.

20. The package of claim 19 wherein the hood is inclined with respect to the protruded path.

21. The package of claim 20 wherein the inlet is positioned on the first polymeric layer proximate to the first enlarged end of the protruded path of the second polymeric layer and the outlet is positioned on the first polymeric layer proximate to the second enlarged end of the protruded path.

22. The package of claim 21 wherein the second polymeric layer is a second thermoformed sheet.

23. The package of claim 22 wherein the protruded path is thermoformed into the second thermoformed sheet.

24. The package of claim 23 further including a third thermoformed sheet enclosing the protruded path.

25. The package of claim 24 wherein the second thermoformed sheet is positioned between the first thermoformed sheet and the third thermoformed sheet.

26. A method of forming a valve through which a user may dispense contents from a storage volume of a package, said method comprising:

forming a fluid communication channel with an inlet and an outlet;

forming a protruded path extending into the fluid communication channel, the protruded path including a first enlarged end and a second enlarged end, the first enlarged end of the protruded path at least partially blocking the fluid communication channel; and capturing a substantially spherical element within said protruded path, the spherical element travelling between a first configuration and a second configuration wherein, in the first configuration, the spherical element is seated in the first enlarged end of the protruded path thereby positioning the second element to block the fluid communication channel and, wherein, in the second configuration, the spherical element is seated in the second enlarged end of the protruded path thereby allowing flow through the fluid communication channel.

* * * * *